United States Patent [19]

Steinberger

[11] Patent Number: 5,018,424

[45] Date of Patent: May 28, 1991

[54] TUNING PEG

[75] Inventor: Ned Steinberger, Cornwall, N.Y.

[73] Assignee: Steinberger Sound Corporation, Newburgh, N.Y.

[21] Appl. No.: 265,693

[22] Filed: Nov. 1, 1988

[51] Int. Cl.[5] ..... G10D 3/14

[52] U.S. Cl. ..... 84/304; 84/306

[58] Field of Search ..... 84/297 R, 200–208, 84/304–306

[56] References Cited

U.S. PATENT DOCUMENTS

| | | | |
|---|---|---|---|
| 345,711 | 7/1886 | McMillan | 84/206 |
| 542,157 | 7/1895 | Goose | 84/306 |
| 594,325 | 11/1897 | Christie | 84/205 |
| 918,543 | 4/1909 | Haubner | 84/306 |
| 1,384,459 | 7/1921 | Grover | 84/305 |
| 1,577,245 | 3/1926 | Bua | 84/312 |
| 1,580,667 | 4/1926 | Hanson | 84/304 |
| 1,713,002 | 5/1929 | Oettinger | 84/304 |
| 3,023,658 | 3/1962 | Gusey | 84/306 |
| 3,830,132 | 8/1974 | Lowe | 84/304 |
| 4,191,086 | 3/1980 | Spercel | 84/306 |
| 4,367,671 | 1/1983 | Chance et al. | 84/306 |
| 4,452,120 | 6/1984 | Chance et al. | 84/306 |
| 4,625,614 | 12/1986 | Spercel | 84/306 |
| 4,674,387 | 6/1987 | Caruth | 84/304 |
| 4,768,415 | 9/1988 | Gressett et al. | 84/298 |
| 4,872,388 | 10/1989 | Gunn | 84/304 |

FOREIGN PATENT DOCUMENTS

| | | | |
|---|---|---|---|
| 231064 | 3/1925 | United Kingdom | 84/304 |

*Primary Examiner*—Lawrence R. Franklin

*Attorney, Agent, or Firm*—Finnegan, Henderson, Farabow, Garrett & Dunner

[57] ABSTRACT

A tuning peg for a stringed musical instrument comprises a cylindrical housing adapted to be mounted on a stringed musical instrument. The housing has a central chamber, an axially extending slot and a shearing surface. A slider is positioned within the central chamber and has a key projecting into the slot for allowing the slider to move axially relative to the housing and for preventing rotation of the slider relative to the housing. One end of the slider has a transverse aperture for receiving a string, a screw for clamping the string in the aperture and a shearing surface proximate to the aperture and the shearing surface on the housing. A knob is threaded on the other end of the slider. The knob is rotatable relative to the housing but is prevented from axial movement relative to the housing such that rotation of the knob moves the slider in the axial direction to tune the string and shear the string between the shearing surfaces.

7 Claims, 2 Drawing Sheets

TUNING PEG

BACKGROUND OF THE INVENTION

1. Field of the Invention

The present invention relates to a device for tuning and cutting the strings of a musical instrument.

2. Description of the Related Art

Stringed instruments must have their strings adjustably tightened to the proper tension to be in tune. A device for tuning an instrument such as a guitar is shown in U.S. Pat. No. 3,830,132 to Lowe. In the tuning peg of Lowe a slider is axially movable and keyed inside a housing. The slider has a transverse hole at its upper end for receiving a string. The string is wrapped around the slider one or more times and is placed in a groove in the top of the slider. The slider also has a longitudinal hole that mates with a screw that passes through the base of the housing. Rotation of the screw causes the slider to slide along the axis of the screw. The attached string is thereby stretched to the desired tension and tuned. In Lowe the excess of the string is broken off by being moved back and forth against a shoulder of the groove in the top of the slider until the string fails by metal fatigue. This procedure is somewhat time consuming.

Accordingly, it is an object of this invention to provide a device which quickly and easily removes the excess string projecting from the tuning peg.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out in the appended claims.

SUMMARY OF THE INVENTION

To achieve the foregoing objects, and in accordance with the purposes of the invention as embodied and broadly described herein, there is provided a tuning peg for a stringed musical instrument. The tuning peg comprises means for holding the string, including a shearing surface, and means for mounting the string holding means on the musical instrument including a shearing surface proximate to the shearing surface on the holding means. The tuning peg also comprises means for moving the holding means relative to the mounting means to shear the string between the shearing surfaces and to tune the string by moving the string relative to the mounting means.

It is preferable that the means for holding the string includes a slider having a transverse aperture at one end thereof for receiving a string, screw means for clamping the string in the aperture and a shearing surface proximate to the aperture. It is also preferable that the means for mounting the string holding means includes a cylindrical housing adapted to be mounted on a stringed musical instrument, where the housing has a central chamber, an axially extending slot and a shearing surface. It is further preferable that the means for moving the holding means relative to the mounting means includes a knob threaded on the other end of the slider. Additionally, it is preferable that a substantial portion of the knob surrounds and overlaps the housing in the axial direction.

BRIEF DESCRIPTION OF THE DRAWINGS

The accompanying drawings, which are incorporated in and constitute a part of the specification, illustrate a presently preferred embodiment of the invention and, together with the general description given above and the detailed description of the preferred embodiment given below, serve to explain the principles of the invention.

DESCRIPTION OF THE PREFERRED EMBODIMENT

Reference will now be made in detail to the present preferred embodiment of the invention as illustrated in the accompanying drawings.

Figure 1:
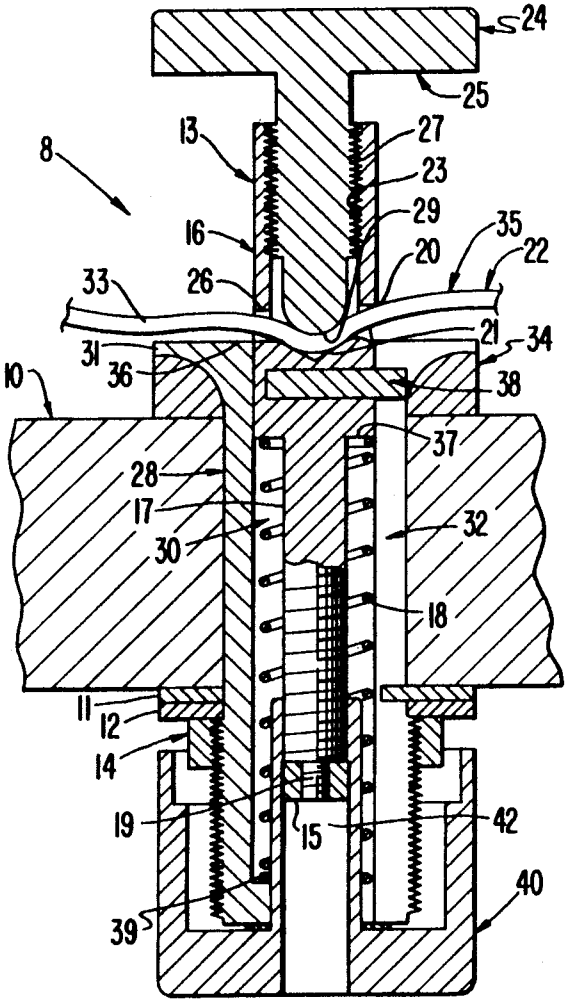
FIG. 1 is a cross section of a tuning peg which incorporates the teachings of the present invention.
Figure 3:
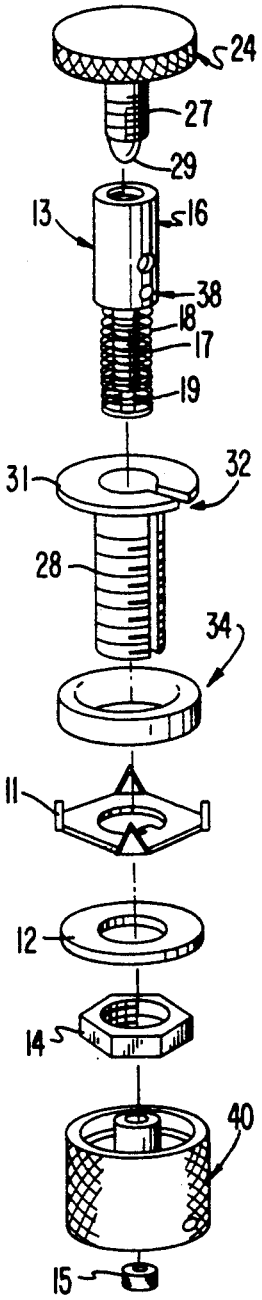
FIG. 3 is an exploded view of the tuning peg shown in FIG. 1.
Figure 4:
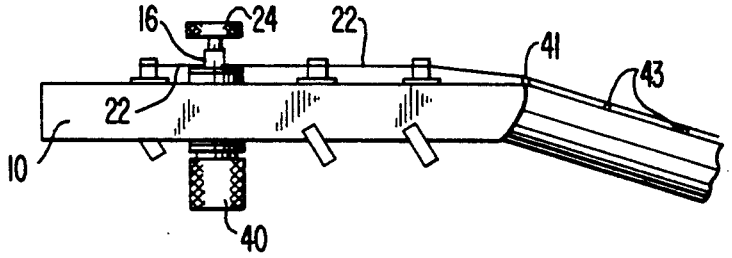
FIG. 4 is a side view of the tuning peg of FIG. 1 mounted on a guitar.

In accordance with the present invention there is provided a tuning peg for a stringed instrument. As shown in FIG. 1, the tuning peg is designated generally by the numeral 8 and is mounted in a hole in the head stock 10 of a stringed instrument such as a guitar. Tuning peg 8 is held in the hole in head stock 10 by means of a lock washer 11, a washer 12 and a nut 14. As shown in FIG. 4, tuning peg 8 extends from head stock 10 so that it is easily accessible from the rear of the head stock for manipulation.

In accordance with the present invention there is provided means for holding the string. As shown in FIG. 1, the holding means includes an axially extending slider shown generally at 16. Slider 16 includes portions of different cross-sectional areas. As shown in FIG. 1 an upper section 13 is larger in diameter than a middle section 17, which in turn is larger in diameter than a lower section 19. A compressed coil spring 18 surrounds middle section 17. One end of coil spring 18 presses against an axial face of upper section 13 to bias slider 16 in an upward direction. A nut 15 is threaded onto lower section 19.

It is preferable that slider 16 includes a transverse aperture 20 in upper section 13 for receiving a string 22. String 22 is extended through aperture 20. It is also preferable to provide screw means for clamping the string in the aperture. As shown in FIG. 1 the screw means includes a screw 24 threaded into a hollow threaded portion 23 of upper section 13 of slider 16. Screw 24 includes an upper knob 25 for manipulation and a middle threaded section 27 which mates with hollow threaded portion 23. Screw 24 also includes a lower reduced diameter rounded portion 29 which intersects aperture 20 and abuts string 22 as screw threaded section 27 is threaded into hollow threaded portion 23 of slider 16. Screw 24 holds string 22 against notch 21 in the lower wall of aperture 20.

As shown in FIG. 1, a free end 33 of string 22 extends from the left side of slider 16. As shown in FIG. 4, a retained portion 35 of string 22 extends from the right side of slider 16 and continues, in normal fashion, passing over the nut 41, frets 43 and bridge (not shown) of the stringed instrument. The string is anchored at its far right end.

In accordance with the present invention the holding means also includes a shearing surface. As shown in FIG. 1, the shearing surface of the holding means includes a shearing surface 26. Shearing surface 26 is formed by the upper surface of aperture 20 on the side of slider 16 from which the free end 33 of string 22 extends.

In accordance with the present invention there is provided means for mounting the string holding means on a musical instrument. As shown in FIG. 1, the mounting means includes a generally cylindrical housing 28 having a central chamber 30. Slider 16 is positioned in central chamber 30 so that it slides within the housing 28. As shown in FIG. 1, the upper surface of housing 28 has a flange 31 at its upper surface. Flange 31 is interrupted by a slot 32 which extends in the axial direction on the side of housing 28 from which the retained portion 35 of the string extends. String 22 extends through and moves in slot 32.

In accordance with the present invention the mounting means also includes bearing means for supporting the string while the string is positioned in the slot. As shown in FIG. 1 the bearing means includes an annular member 34 surrounding the upper portion of housing 28. Annular member 34 is interposed between head stock 10 and the flange 31 on the side of housing 28 from which retained portion 35 of the string extends. On the side of housing 28 near the guitar, annular member 34 is interposed between head stock 10 and slot 32 in housing 28. Annular member 34 provides a bearing surface for string 22 where it extends out of housing 28 toward the body of the guitar.

In accordance with the present invention the mounting means also includes a shearing surface. As shown in FIG. 1, the shearing surface of the mounting means includes a shearing surface 36. Shearing surface 36 is formed by the upper surface of flange 31 of housing 28 on the side of the housing adjacent free end 33 of string 22. As shown in FIG. 1 shearing surface 36 adjoins aperture 20 for shearing free end 33 of string 22 between shearing surfaces 26 and 36.

In accordance with the present invention there is further provided means for preventing relative rotation between the holding means and the housing. As shown in FIG. 1, the preventing means includes a key 38 mounted transversely in upper section 13 of slider 16. Key 38 extends into slot 32 of housing 28 to permit axial movement of slider 16 relative to housing 28 but prevent rotation of the slider relative to housing 28.

In accordance with the present invention there is provided means for moving the holding means relative to the mounting means to shear the string by moving the string relative to the mounting means and tune the string. As shown in FIG. 1, the means for moving the holding means includes a knob 40. Knob 40 is hollow and includes a hole 42. Middle section 17 of slider 16 is threaded and the upper part of hole 42 is threaded onto section 17. Knob 40 and slider 16 are biased in an upward direction by coil spring 28 which extends between shoulder 37 of slider 16 and shoulder 39 of housing 28. Rotation of knob 40 moves slider 16 in the axial direction relative to housing 28 to tune the string and shear the string between shearing surfaces 26 and 36 formed on slider 16 and housing 28, respectively. The axially lower end of housing 28 extends into the hollow interior of knob 40 such that a substantial portion of knob 40 surrounds and overlaps housing 28 in the axial direction. This arrangement allows for a more compact tuning peg relative to a conventional tuning peg such as that shown by Lowe in U.S. Pat. No. 3,830,132.

Figure 2:
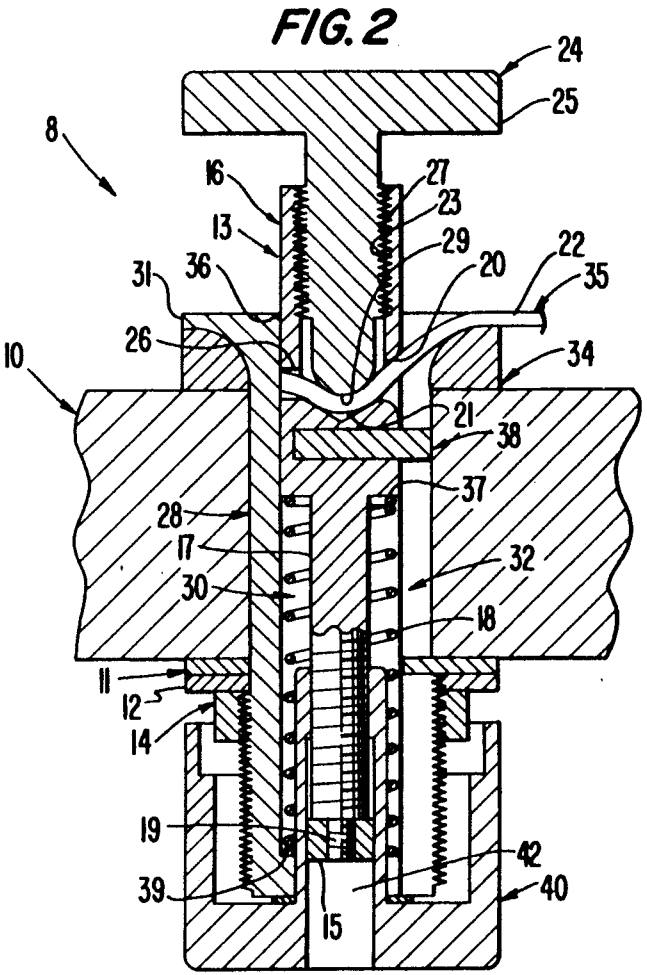
FIG. 2 is a cross section of the tuning peg shown in FIG. 1 after it has been moved to a second position.

In operation, string 22 is extended through transverse aperture 20 in slider 16. The excess of string 22 extends through aperture 20 past shearing surfaces 26 and 36. The portion of string in aperture 20 rests on notch 21. Screw 24 is rotated to clamp string 22 in aperture 20. Subsequently, knob 40 is rotated to move slider 16 axially downward from the position shown in FIG. 1 to that shown in FIG. 2 so that the excess of string 22, shown as free end 33, in FIG. 1 is sheared off at shearing surfaces 26 and 36, leaving the retained portion 35 of string 22 in aperture 20 for subsequent use of the instrument. Movement of slider 16 in the axial direction changes the tension of retained portion 35 of of string 22, thereby tuning the string.

Additional advantages and modifications will readily occur to those skilled in the art. The invention in its broader aspects is, therefore, not limited to the specific details, representative apparatus and illustrative example shown and described. Accordingly, departures may be made from such details without departing from the spirit or scope of the general inventive concept as defined by the appended claims and their equivalents.

What is claimed is:

1. A tuning machine for mounting on a guitar headstock, comprising:

elongated housing means for extending substantially through the headstock of the guitar substantially perpendicular thereto, including a shearing surface, a bearing surface, and a slot aligned with a string of the guitar and extending in an axial direction from the bearing surface into the housing means for allowing the string to slidably move therein;

holding means slidably positioned in the housing means for moving longitudinally in the housing means, including an aperture substantially aligned with the direction of the string on the guitar for receiving the string therein, means for securing the string in the aperture substantially in alignment throughout its length with the direction of the string on the guitar, the string having an end portion which exits the aperture, and the holding means also including another shearing surface; and tuning means for moving the holding means longitudinally relative to the housing means and simultaneously drawing the string into the slot over the bearing surface and shearing the end portion of the string between the shearing surfaces without rotating the holding means in the housing means.

2. The machine as claimed in claim 1, wherein the holding means includes screw means for clamping the string in the aperture.

3. The machine as claimed in claim 1, wherein the tuning means includes a knob threaded on the holding means.

4. The machine as claimed in claim 3, wherein the housing means includes a housing surrounding the holding means, the housing and the holding means extending in the axial direction, and wherein a substantial portion of the knob surrounds and overlaps the housing in the axial direction.

5. The machine as claimed in claim 1, wherein the housing means includes a housing surrounding the holding means and wherein the housing and the holding means extend in the axial direction.

6. The device as claimed in claim 1, wherein the bearing surface includes an annular member surrounding the housing means.

7. The machine of claim 1 wherein the holding means includes a key extending into the slot in the housing means for preventing rotation of the housing means with respect to the housing means.

* * * * *

UNITED STATES PATENT AND TRADEMARK OFFICE

CERTIFICATE OF CORRECTION

PATENT NO. : 5,018,424

DATED : May 28, 1991

INVENTOR(S) : Ned Steinberger

It is certified that error appears in the above-identified patent and that said Letters Patent is hereby corrected as shown below:

Claim 2, col. 4, line 47, change "holding" to --securing--.

Claim 6, col. 4, line 61, change "device" to --machine--.

Signed and Sealed this

Third Day of November, 1992

*Attest:*

DOUGLAS B. COMER

*Attesting Officer*

*Acting Commissioner of Patents and Trademarks*